US005125162A

United States Patent [19]

Prebeck

[11] Patent Number: 5,125,162

[45] Date of Patent: Jun. 30, 1992

[54] BRICK ALIGNMENT CLIPS

[76] Inventor: Alfreda Prebeck, 38105 Reimold St., Mt. Clemens, Mich. 48045

[21] Appl. No.: 751,863

[22] Filed: Aug. 28, 1991

[51] Int. Cl.[5] ..... G01C 15/10

[52] U.S. Cl. ..... 33/408; 33/410; 33/409

[58] Field of Search ..... 33/408, 409, 410

[56] References Cited

U.S. PATENT DOCUMENTS

| | | | |
|---|---|---|---|
| 2,529,056 | 11/1950 | Sprowl | 33/408 |
| 2,603,875 | 7/1952 | Kroll | 33/409 |
| 2,629,178 | 2/1953 | Zinken | 33/410 |
| 2,806,290 | 9/1957 | Tiefel | 33/408 |
| 3,119,186 | 1/1964 | Stewart . | |
| 3,156,982 | 11/1964 | Wahlin . | |
| 3,440,729 | 4/1969 | Allison | 33/410 |
| 3,461,565 | 8/1969 | Harris . | |
| 3,626,434 | 12/1971 | Miller . | |
| 3,698,089 | 10/1972 | Huston . | |
| 3,729,828 | 5/1973 | McKenzie . | |
| 3,751,810 | 8/1973 | Valva | 33/410 |
| 4,477,980 | 10/1984 | Jukes . | |
| 4,599,804 | 7/1986 | Amos . | |
| 4,995,152 | 2/1991 | Stezkler | 33/409 |

FOREIGN PATENT DOCUMENTS

| | | | |
|---|---|---|---|
| 1143685 | 2/1969 | United Kingdom | 33/413 |

*Primary Examiner*—Thomas B. Will
*Attorney, Agent, or Firm*—Dykema Gossett

[57] ABSTRACT

A unique brick alignment clip is disclosed comprising a top face, and front and rear faces positioned on faces of a brick. A line extends between adjacent clips to align a plurality of bricks. In one aspect of the present invention the front of the clip has irregular toothed surfaces which are drawn into the laterally outward face of the brick to secure the clip on the brick. Further, a thumb screw in the rear face also helps secure the clip on the brick. In another feature of the present invention the line extends through a central slot in the front face and around front and rear ears to secure the line to the clip. The ears are speced laterally from a central axis of the clip, while the center slot is aligned with the central axis. The line extends rearwardly from the center slot and around the ears, such that the direction of the application of force from the line to the clip is predictable.

3 Claims, 2 Drawing Sheets

BRICK ALIGNMENT CLIPS

BACKGROUND OF THE INVENTION

This application relates to a unique clip which allows the alignment of a plurality of bricks.

It often becomes difficult to properly align and position a plurality of bricks as they are placed to build a wall in a brick structure. When a wall extends for a relatively great distance it is difficult to ensure that the forward faces of each of the bricks are properly positioned relative to each other. Also, it is difficult to ensure that each brick is properly positioned relative to each other such that they lie in the same vertical plane.

The use of alignment clips to ensure proper alignment of a plurality of bricks is known. The clips are used in groups of two, with a line extending between the clips. The lines ensure that the bricks are in a proper attitude relative to each other as a workman builds a wall.

One example of such a prior art clip is disclosed in U.S. Pat. No. 2,806,290. In this patented device, a clip includes a top face, a front face, and a rear face. The front face includes a central slot which receives the line to align a plurality of bricks. A pair of ears are formed on the top face to secure the line to the clip. The ears and center slot are all centered on the center axis of the clip. The line must thus extend through a tortuous path from the center slot and around the ears to be secured to the clip. When a force is applied to the line such that it taunt between two adjacent clips, the force may be misdirected on the clip since the line extends through the tortuous path at a plurality of angles. Further, the forward most of the ears extends over the center notch and the line may become tangled.

Further deficiencies in this type of prior art clip are experienced with regard to the securement of the clip on a brick. The prior art clip typically has a smooth front face, and may slide along the face of the brick. This would be undesirable, since a relatively strong force is applied on the clip from the line extending between two adjacent clips. The prior art clips may slide on the brick once this force was applied.

SUMMARY OF THE INVENTION

In one disclosed embodiment a clip has a top face, and front and rear faces. The lateral edges of the front face of the clip are formed with an irregular toothed surface. When a force is applied to the clip, the toothed surface pivots into the brick. This prevents the clip from sliding on the brick. A thumb screw preferably extends through the rear face, and may be tightened to better secure the clip on the brick. The thumb screw may be used with smooth brick, or when the clip is utilized with a plurality of different width bricks.

In another aspect of the present invention, a center slot is formed through the front face. Front and rear ears are formed on the top face, and a line extends through the center slot and around the ears. The ears are preferably spaced laterally from a center axis of the clip. In this way, the line may extend from the center slot directly rearwardly along the top face, around the rear ear, and axially forwardly to a position around the front ear. When a force is applied to the clip from the line, it is directed into the clip in a direction that is more predictable than with the prior art clips. In a preferred embodiment of the present invention the front ear has a leading or axially forward edge which does not extend axially forwardly to the front end of the top face. In this way, the line around the front ear does not extend to a position axially adjacent the center slot, where it can become tangled.

These and other objects and features of the present invention can be best understood from the following specification and drawings of which the following is a brief description.

DETAILED DESCRIPTION OF A PREFERRED EMBODIMENT

Figure 1:
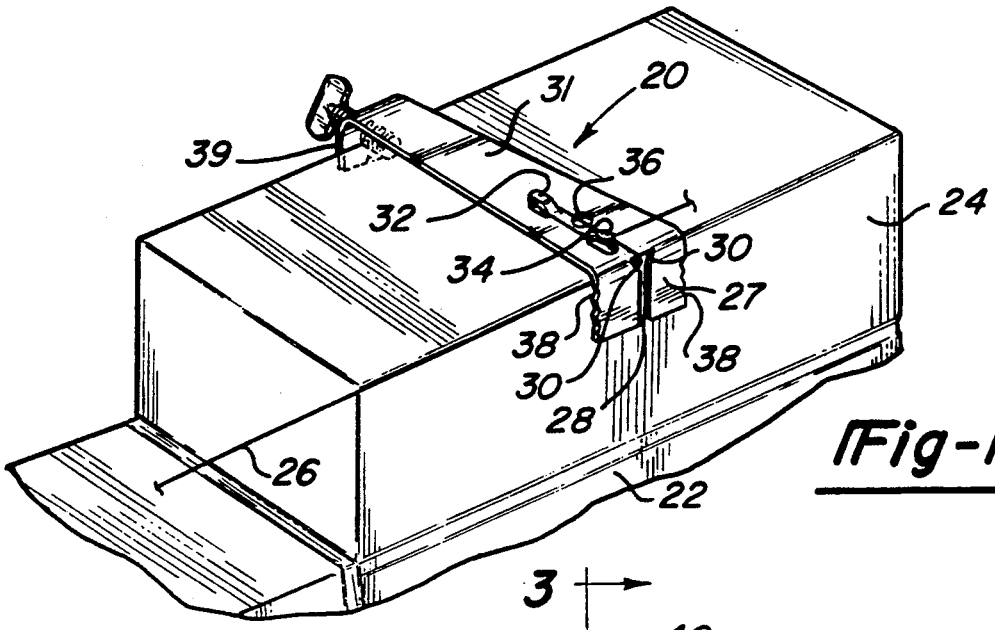
FIG. 1 is a perspective view showing an inventive clip on a brick wall.

Alignment clip 20 is illustrated in FIG. 1 for aligning forward faces of a plurality of bricks in a brick wall 22. Clip 20 is positioned on a brick 24, which is initially positioned in a proper attitude such that it is parallel to a desired final wall 22. A second brick 24 is properly positioned at an opposed end of wall 22, and a second clip 20 is positioned on that second brick.

Although clip 20 is illustrated with solid bricks, and although the term "bricks" is used throughout this application, it should be understood that this invention extends to all type of bricks or block. The term "brick" as used in this application should be read as extending to all types of bricks or block. Alignment clip 20 need not extend between front and rear faces of the brick, but instead could extend over the thickness between a front face and the center aperture in a block.

A line 26 extending between spaced clips 20 is utilized to define the proper aligned position for bricks which are positioned between spaced bricks 24. A front face 27 of clip 20 includes a center slot 28 which receives line 26. A pair of notches 30 extend laterally outwardly from center slot 28 in both lateral directions of front face 27. Line 26 is drawn taunt between spaced clips 20, and line 26 is pulled into a notch 30. From notch 30 line 26 extends axially rearwardly along a top face 31 of alignment clip 20 to be wrapped around a rear ear 32. From rear ear 32 line 26 is wrapped axially forwardly to a front ear 34. When line 26 is wrapped around ears 32 and 34, it secures itself to clip 20. As line 26 is secured around the spaced clips 20, it is drawn taunt such that a force is directed from line 26 to each of the spaced clips 20. The clips are then pulled towards each other.

A hole 36 extends through top face 31. Line 26 may be tied through hole 36 to better secure line 26 to clip 20. This is particularly valuable when clip 20 is used on high walls, where it would be particularly undesirable for clip 20 to fall off of line 26, and to the ground.

As line 26 is drawn taunt, each clip 20 tends to pivot in a direction towards the opposed clip 20. The laterally outward edges of front face 28 are formed with irregular edges, or toothed surfaces 38. As clip 20 pivots on brick 24, these toothed surfaces 38 are forced into the outer face of brick 24. Clip 20 is thus retained at a desired position on brick 24, and will not slide.

A rear face 39 is defined at an axially rear end of top face 31 and receives a thumb screw 40. Thumb screw 40 may be adjusted to better secure clip 20 on brick 24. This may be particularly useful when brick 24 is smooth, and there is not an adequate surface for toothed edges 38 to grip. Further, clip 20 may be formed of a thin metal such that it may be bent to conform to the particular dimension of brick 24. This will also serve to secure clip 20 on a particular brick 24.

Figure 2:
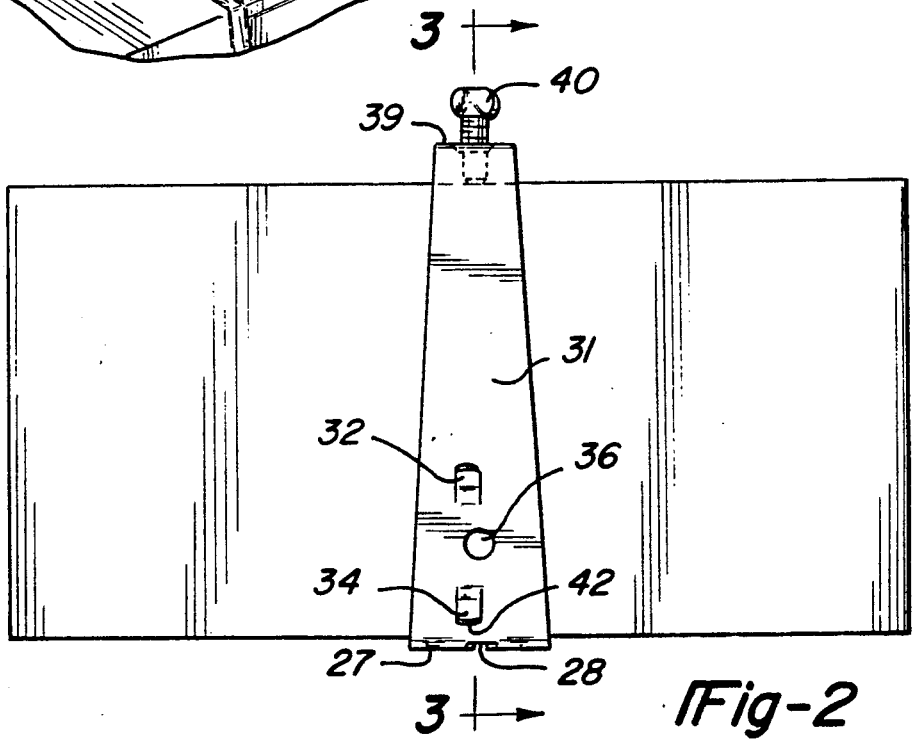
FIG. 2 is a plan view of the clip mounted on a brick.

FIG. 2 is a top view of clip 20, and shows ears 32 and 34 spaced slightly laterally from a center axis of clip 20. Center slot 28 is centered on the center axis. When line 26 extends axially rearwardly from center slot 28 it extends along the center axis. It is then wrapped around ears 32 and 34 at positions spaced slightly laterally from the center axis. In this way it is ensured that the forces from the line on ears 32 and 34 are in a predictable direction relative to the center axis of clip 20.

Leading edge 42 of front ear 34 does not extend axially forwardly to the front end of top face 31, where center slot 28 is found. Thus, the portion of line 26 wrapped around ear 34 does not become entangled with the portion of line 26 positioned through slot 28.

Figure 3:
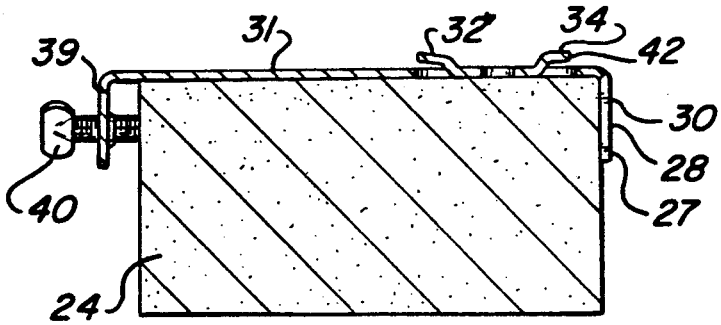
FIG. 3 is a cross-sectional view along line 3—3 as shown in FIG. 2.

FIG. 3 is a cross-sectional view along line 3—3 as shown in FIG. 2. Ears 32 and 34 are punched outwardly of the planar top face 31 of clip 20. Further, as stated above, leading edge 42 does not extend to the axially forward end of top face 31. Thumb screw 40 is shown tightened within rear face 39 such that it abuts a rear face of brick 24. Again, thumb screw 40 is an optional feature.

Figure 4:
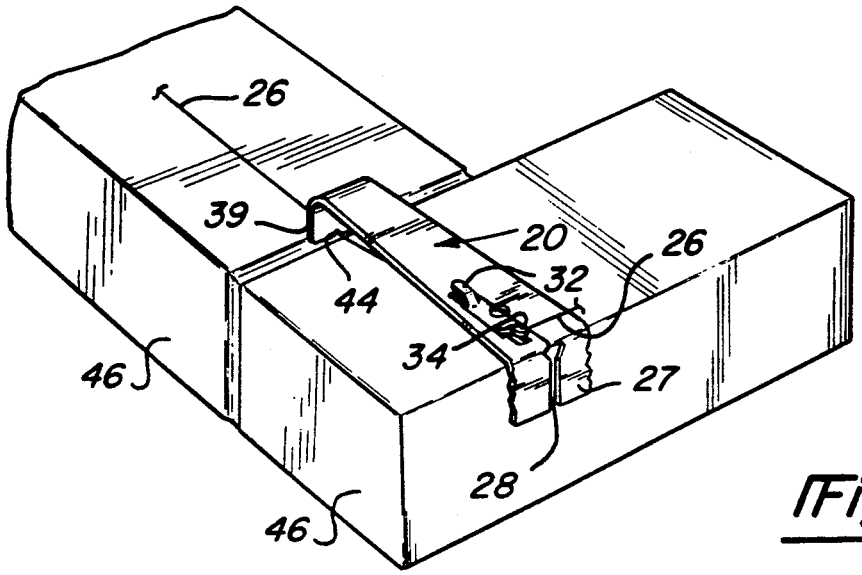
FIG. 4 is a perspective view showing the clip of the present invention mounted on a brick wall and performing a second function.

FIG. 4 shows a second function for clip 20. Line 26 is shown secured to ears 32 and 34, and extending through both slot 28 and a rear slot 44 formed in rear face 39. Rear slot 44 positions line 26 at the top of a brick 46. In this way, clip 20 ensures that the vertical position of adjacent bricks 46 are proper.

Figure 5:
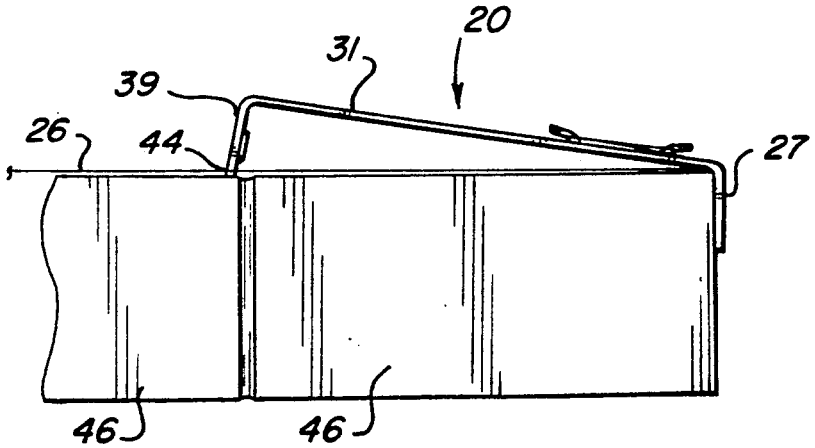
FIG. 5 is a side view of the clip shown in FIG. 4.

FIG. 5 shows clip 20 utilized as illustrated in FIG. 4. Clip 20 is pivoted on brick 46 such that rear face 39 rests on a vertical top of brick 46. Line 26 extends axially rearwardly through notch 44, and ensures that the vertical tops of adjacent bricks 46 are aligned.

Figure 6:
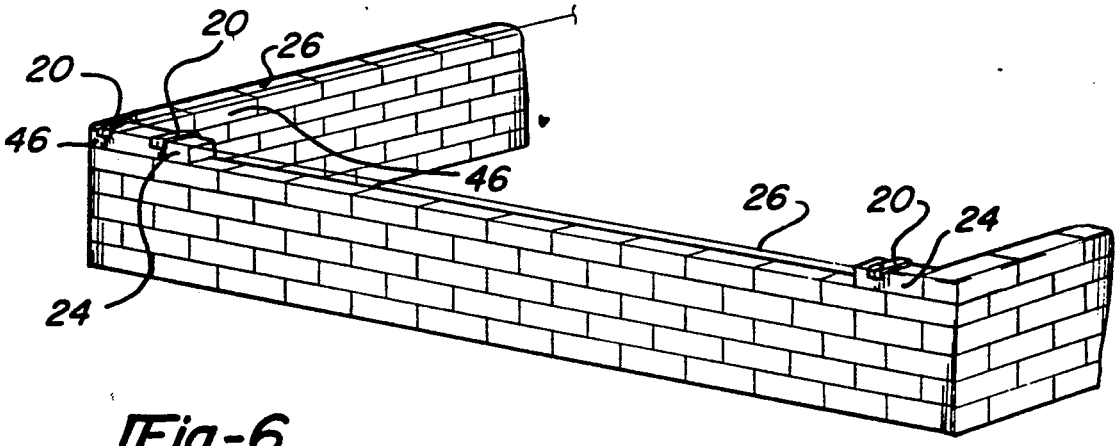
FIG. 6 is a perspective view showing both functions of the clip of the present invention.

FIG. 6 shows the use of clips 20 in both functions disclosed in this invention. Adjacent clips 20 are positioned on bricks 24 spaced by a particular distance, with line 26 extending between the clips 20. Line 26 ensures that bricks positioned between bricks 24 and parallel to each other.

In the second function, clip 20 is positioned on top of brick 46. A second unillustrated clip 20 is positioned on a rearward brick 46. Line 26 ensures that all bricks positioned between the spaced bricks 46 are in the same vertical position.

In a preferred embodiment of the present invention clip 20 is stamped out of a thin flexible metal such that it may be deformed to conform to a particular sized brick. Preferably, the metal is 0.03"–0.12" thick soft to mild steel. The ears, slots, and toothed edges are all preferably stamped or blanked from the thin metal.

A preferred embodiment of the present invention has been disclosed, however, a worker of ordinary skill in the art would recognize that certain modifications would come within the scope of this invention. For that reason the following claims should be studied in order to determine the true scope and content of this invention.

I claim:

1. A clip adapted to be placed on a brick, straddling the brick, with a line for aligning a plurality of bricks extending between the clip and the bricks, generally parallel to the bricks and perpendicular to the longitudinal axis of the clip, the clip comprising:

a generally planar top face extending along said longitudinal axis, said top face having front and rear axial ends;

a front face extending generally perpendicular to said top face from said front end, a central slot formed in said front face and extending from a lowermost end of said front face towards said top face;

a rear face extending generally perpendicular to said top face from said rear axial end, the distance between said front and rear faces being approximately equal to the width of the bricks that are to be aligned by the clip such that the clip straddles the brick; and front and rear ears positioned on said top face and extending off of said top face in a direction opposite to the direction said front face extends from said top face, said front and rear ears positioned at laterally spaced locations on one side of a central axis of said clip, said central slot being centered on said central axis such that said central slot is laterally offset from said front and rear ears, said front ear extends axially towards said front end to a first axial position, said first axial position being removed rearwardly from said front end of said top face, such that a line used for aligning the plurality of bricks may extend between said front face and the plurality of bricks generally perpendicular to said longitudinal axis, parallel to the planar surfaces defined by an inner side of said front face and the plurality of bricks, and then upwardly through said central slot, onto said planar top face, rearwardly along said top face and around said ears with the offset positioning of said front and rear ears, and the axial positioning of said front ear ensuring that forces from said line are not misdirected onto said front and rear ears to result in misalignment of the clip and that said line not becoming tangled.

2. A clip as recited in claim 1, wherein said central slot being of a first lateral dimension for a majority of its length, and having notches extending laterally outwardly towards both lateral sides near a junction point between said front face and said front end of said top face, said notches adapted to receive a line at said front end, and assure that the line is properly positioned on a brick.

3. A clip as recited in claim 1, wherein said front face having a lateral dimension which is parallel to said front end, and two lateral sides, with said lateral sides having an irregular surface with a plurality of toothed projections.

* * * * *